US009997877B2

(12) United States Patent
Carbone et al.

(10) Patent No.: US 9,997,877 B2
(45) Date of Patent: Jun. 12, 2018

(54) RECEPTACLE WITH NON-CONDUCTIVE RETAINING PIN

(71) Applicant: Hubbell Incorporated, Shelton, CT (US)

(72) Inventors: Christopher A. Carbone, Newtown, CT (US); Thomas L Scanzillo, Monroe, CT (US); Lawrence Turner, Seymour, CT (US)

(73) Assignee: Hubbell Incorporated, Shelton, CT (US)

( * ) Notice: Subject to any disclaimer, the term of this patent is extended or adjusted under 35 U.S.C. 154(b) by 0 days. days.

(21) Appl. No.: 14/496,535

(22) Filed: Sep. 25, 2014

(65) Prior Publication Data

US 2016/0093995 A1 Mar. 31, 2016

(51) Int. Cl.

| | |
|---|---|
| ***H01R 13/426*** | (2006.01) |
| ***H01R 13/62*** | (2006.01) |
| ***H01R 24/66*** | (2011.01) |
| ***H01R 4/22*** | (2006.01) |

(52) U.S. Cl.

CPC ..... *H01R 24/66* (2013.01); *H01R 4/22* (2013.01); *H01R 13/426* (2013.01)

(58) Field of Classification Search

CPC . H01R 24/66; H01R 4/22; H01R 4/50; H01R 2101/00

USPC .... 439/733.1, 750, 452, 449, 660, 670, 671, 439/522, 202, 388, 134, 825, 82; 174/155

See application file for complete search history.

(56) References Cited

U.S. PATENT DOCUMENTS

| | | | | | |
|---|---|---|---|---|---|
| 1,409,626 | A * | 3/1922 | Walther | F16B 13/0808 | 411/345 |
| 2,028,528 | A * | 1/1936 | Sipe | F16B 19/02 | 238/14.13 |
| 2,195,598 | A * | 4/1940 | Olson | F16B 19/02 | 238/14.14 |
| 2,654,073 | A * | 9/1953 | Katz | H01R 13/447 | 439/134 |
| 2,814,024 | A * | 11/1957 | Narozny | H01R 12/58 | 439/58 |
| 3,543,215 | A * | 11/1970 | Jones | H01R 12/718 | 439/82 |
| 4,105,273 | A * | 8/1978 | Henschke | H01R 13/44 | 439/290 |
| 4,105,280 | A * | 8/1978 | Thompson, Jr. | H01H 1/385 | 439/700 |
| 4,693,688 | A * | 9/1987 | Cembruch | H01R 4/64 | 439/101 |

(Continued)

OTHER PUBLICATIONS

Hubbell Brochure, "Entertainment Product Solution Guide", Nov. 2013, pp. 1-16.

(Continued)

*Primary Examiner* — Michael A Lyons
*Assistant Examiner* — Milagros Jeancharles
(74) *Attorney, Agent, or Firm* — Wissing Miller LLP

(57) ABSTRACT

Panel mount electrical receptacles having a panel mount housing for securing the receptacle to a panel wall, one or more electrical connectors for electrical connections, and one or more non-conductive retaining pin that secures each electrical connector to the panel mount housing are provided.

28 Claims, 6 Drawing Sheets

(56) References Cited

U.S. PATENT DOCUMENTS 4,938,718 A * 7/1990 Guendel ..... H01R 13/6456 439/320
4,974,989 A * 12/1990 Salter ..... F16B 5/02 29/525
5,001,443 A * 3/1991 Martin, III ..... H01P 5/10 333/125
5,067,909 A * 11/1991 Behning ..... H01R 13/62 439/312
5,423,692 A * 6/1995 Francis ..... H01R 13/213 439/335
5,685,730 A * 11/1997 Cameron ..... H01R 13/6397 439/333
5,893,782 A * 4/1999 Harting ..... H01R 13/17 439/265
5,928,005 A * 7/1999 Li ..... H01R 4/50 439/632
5,929,382 A * 7/1999 Moore ..... B60R 16/02 174/72 A
6,071,145 A * 6/2000 Toly ..... H01R 13/53 439/465
6,206,714 B1 * 3/2001 Bernardini ..... H01R 13/213 439/166
6,309,258 B1 * 10/2001 Measley ..... H01R 11/05 439/224
7,082,651 B2 * 8/2006 Ninomiya ..... A44C 5/2052 24/616
7,387,522 B2 * 6/2008 Janos ..... F21S 8/065 439/18
7,425,152 B2 * 9/2008 Hardt ..... H01R 13/53 439/578
7,488,905 B2 2/2009 Kiely et al.
7,658,657 B1 * 2/2010 Scanzillo ..... H01R 13/17 439/825
7,938,670 B2 * 5/2011 Nania ..... H01R 13/6271 439/354
2014/0127926 A1 5/2014 Condo et al.

OTHER PUBLICATIONS

Hubbell Brochure, "Section F, Single Pole Connectors", pp. F1-F6.
PCT International Search Report and Written Opinion dated Jan. 6, 2016 from corresponding Application No. PCT/US15/51961, 13 pages.

* cited by examiner

RECEPTACLE WITH NON-CONDUCTIVE RETAINING PIN

BACKGROUND

Field

The present disclosure relates to electrical receptacles with non-metallic retaining pins, and more specifically to panel mount receptacles with non-metallic retaining pins that retain an electrical connector within a receptacle housing.

Description of the Related Art

In many industrial and commercial indoor and outdoor environments single pole panel mount receptacles are used with cabling to provide electrical power for numerous applications, such as to supply power to machinery, generators, to lighting systems and sound stages, to amusement park rides, and to sporting stadiums.

Such panel mount receptacles may be male or female receptacles and include a receptacle housing and a contact mounted within the housing. In some prior panel mount receptacles, the contacts were mounted to the receptacle housing using a metallic retaining pin inserted through one side of an exterior of the receptacle housing, through the contact, and out the other side of the receptacle housing. In such receptacles, the metallic pin, which conducts electricity, was exposed on the outer surface of the receptacle thereby being a potential hazard to those who would touch the receptacle. To prevent shock, vendors applied a non-conductive epoxy over the area of the exposed pins. However, over time the epoxy coating degrades and chips off the pin thereby exposing the pin to human contact.

SUMMARY

The present disclosure relates generally to electrical receptacles with non-conductive retaining pins, and more specifically to panel mount receptacles with a non-metallic retaining pin to retain a contact within a receptacle housing.

In one embodiment, the panel mount receptacle includes an electrical connector having a contact and a termination, and a panel mount housing having a mounting section that provides a mounting structure for securing the panel mount receptacle to a panel wall. The panel mount housing also includes an extension ring extending from one side of the mounting section, and a contact shroud extending from another side of the mounting section. In this embodiment, the extension ring has an elongated key extending the length of the extension ring, and a pair of holes, and the electrical connector has an elongated keyway configured to mate with the elongated key of the extension ring, and a hole that can be aligned with the pair of holes in the extension ring. The electrical connector is positioned within the panel mount housing such that the termination extends outwardly from the extension ring, the elongated keyway is mated with the elongated key, and at least a portion of the contact is positioned within the contact shroud. The electrical connector is secured to the panel mount housing with a non-conductive retaining pin positioned in the pair of holes in the extension ring and the hole in the electrical connector. Preferably, the electrical connector is formed of brass, the panel mount housing is formed of thermoplastic, and the non-conductive retaining pin is formed of a non-metallic material, for example, thermoplastic. In one embodiment, the non-conductive retaining pin has an endcap and a tapered diameter such that a widest diameter is adjacent the endcap and a narrowest diameter is at a distal end. In another embodiment, the non-conductive retaining pin has a uniform diameter, an endcap, and a plurality of tapered crushing ribs, where each crushing rib extends from the endcap to a distal end. In another embodiment, the non-conductive retaining pin has a pair of endcaps and a tapered diameter. One endcap can be positioned adjacent one of the pair of holes in the extension ring and the other endcap can be positioned adjacent the other of the pair of holes in the extension ring.

Another embodiment of the panel mount receptacle includes an electrical connector having a contact and a termination, and a panel mount housing. In this embodiment, the panel mount housing has a mounting section that provides a mounting structure for securing the panel mount receptacle to a panel wall, an extension ring extending from one side of the mounting section and having a pair of holes, and a contact shroud extending from another side of the mounting section. Preferably, the electrical connector has a hole that can be aligned with the pair of holes in the extension ring, and is positioned within the panel mount housing such that the termination extends outwardly from the extension ring, and at least a portion of the contact is positioned within the contact shroud. The electrical contact is secured to the panel mount housing with a non-conductive retaining pin positioned in the pair of holes in the extension ring and the hole in the electrical connector. Preferably, the electrical connector is formed of brass, the panel mount housing is formed of thermoplastic, and the non-conductive retaining pin is formed of a non-metallic material, for example, thermoplastic. In one embodiment, the non-conductive retaining pin has an endcap and a tapered diameter such that a widest diameter is adjacent the endcap and a narrowest diameter is at a distal end. In another embodiment, the non-conductive retaining pin has a uniform diameter, an endcap, and a plurality of tapered crushing ribs, where each crushing rib extends from the endcap to a distal end. In yet another embodiment, the non-conductive retaining pin has a pair of endcaps and a tapered diameter. One endcap can be positioned adjacent one of the pair of holes in the extension ring, and the other endcap can be positioned adjacent the other of the pair of holes in the extension ring, and the tapered diameter has a widest diameter adjacent one endcap and a narrowest diameter adjacent the other endcap. The endcap adjacent the narrowest diameter of the non-conductive retaining pin is formed after the non-conductive retaining pin is positioned in the pair of holes in the extension ring.

Another embodiment of the panel mount receptacle includes a panel mount housing having a mounting section that provides a mounting structure for securing the panel mount receptacle to a panel wall, and a contact shroud extending from one side of the mounting section. An electrical connector having a contact and a termination is positioned within the panel mount housing such that the termination extends outwardly from a side of the mounting section opposite the contact shroud, and at least a portion of the contact is positioned within the contact shroud. A non-conductive retaining pin positioned within a pair of holes in the panel mount housing and within a hole in the electrical connector secures the electrical connector to the panel mount housing. The non-conductive retaining pin can have various embodiments, such as those described above.

The mounting section may have an extension ring extending from another side of the mounting section. The extension ring may have the pair of holes, and an elongated key that mates with an elongated keyway in the electrical connector. In this configuration, the electrical connector is positioned within the panel mount housing such that the termination extends outwardly from the extension ring, the elongated keyway is mated with the elongated key, and the at least a portion of the contact is positioned within the contact shroud.

BRIEF DESCRIPTION OF THE DRAWINGS

The figures depict embodiments for purposes of illustration only. One skilled in the art will readily recognize from the following description that alternative embodiments of the structures illustrated herein may be employed without departing from the principles described herein, wherein.

DETAILED DESCRIPTION

Figure 1:
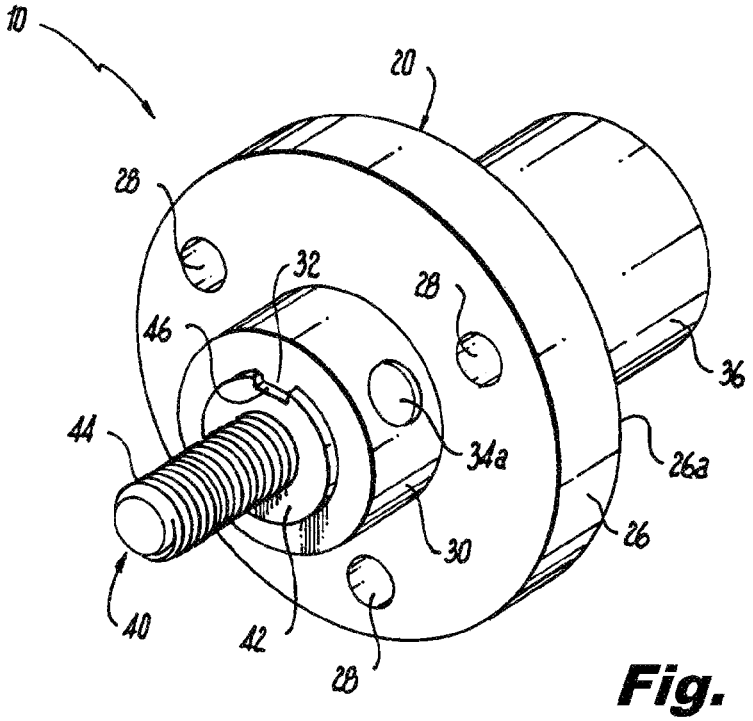
FIG. 1 is a perspective view of a panel mount receptacle stud type according to one embodiment of the present disclosure.

The present disclosure generally provides electrical panel mount receptacles that have a non-metallic retaining pin that secures an electrical connector to a panel mount housing. Referring to FIG. 1, an embodiment of a panel mount receptacle 10 is shown. In this embodiment, the receptacle 10 includes a panel mount housing 20 and an electrical connector 40. The panel mount housing 20 has a receptacle side 22 (seen in FIG. 5) that is accessible from an exterior of a panel when installed, and a termination side 24 (seen in FIG. 5) that is accessible from an interior of a panel when installed.

Figure 5:
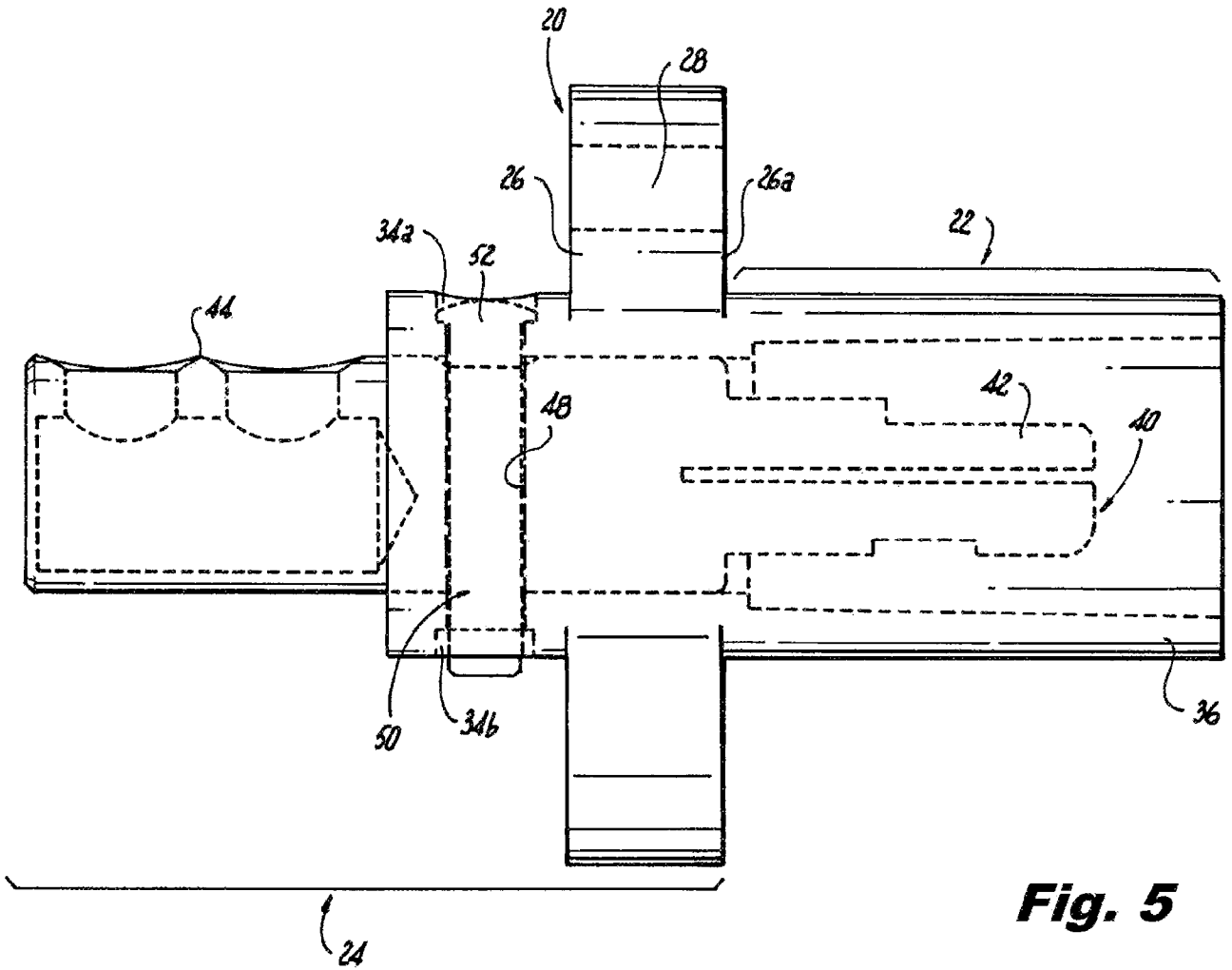
FIG. 5 is a side view of an embodiment of a male receptacle double set type with the non-metallic pin inserted and prior to heat staking the pin.
Figure 6:
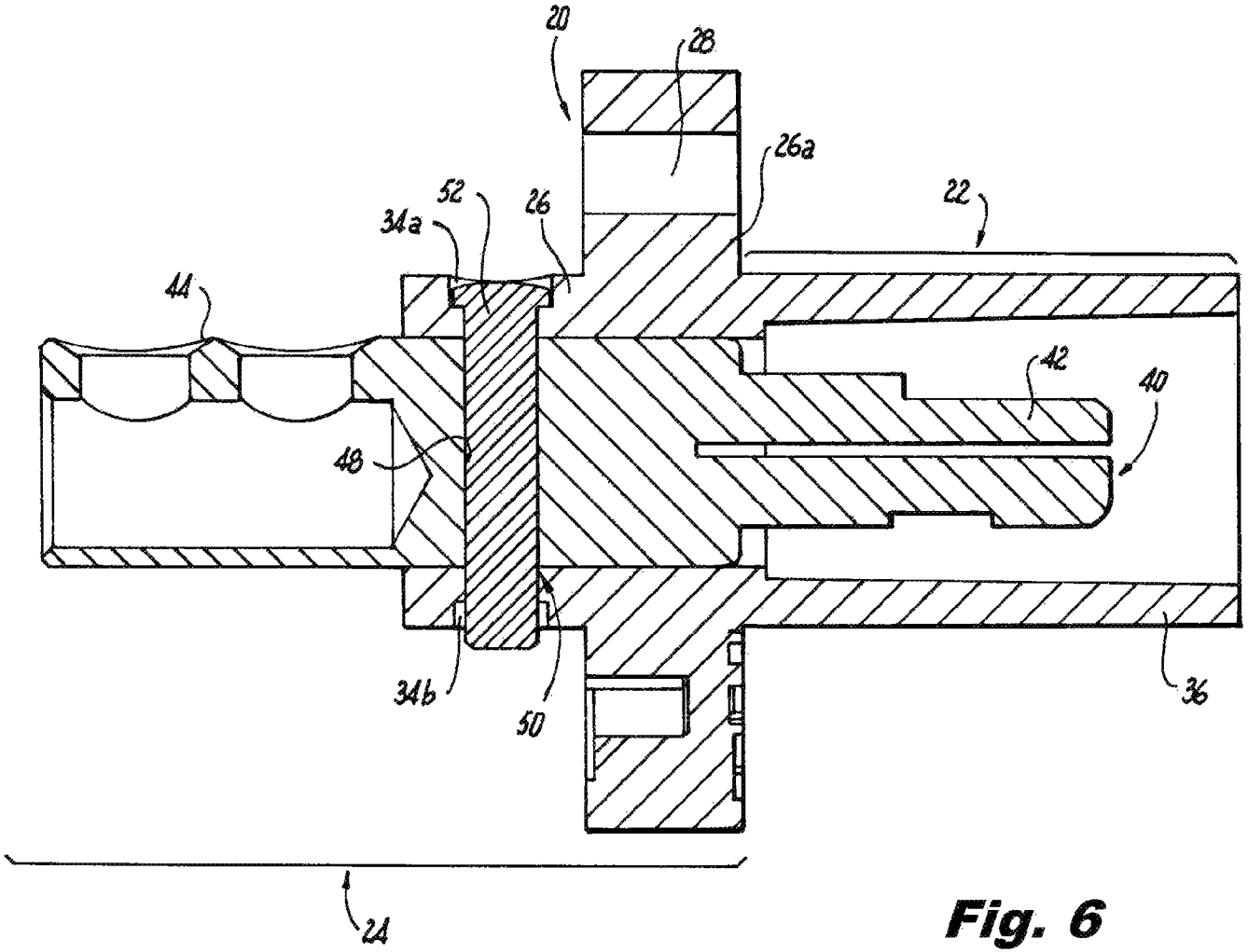
FIG. 6 is a cross-sectional view of the male receptacle prior to heat staking pin of FIG. 4.
Figure 7:
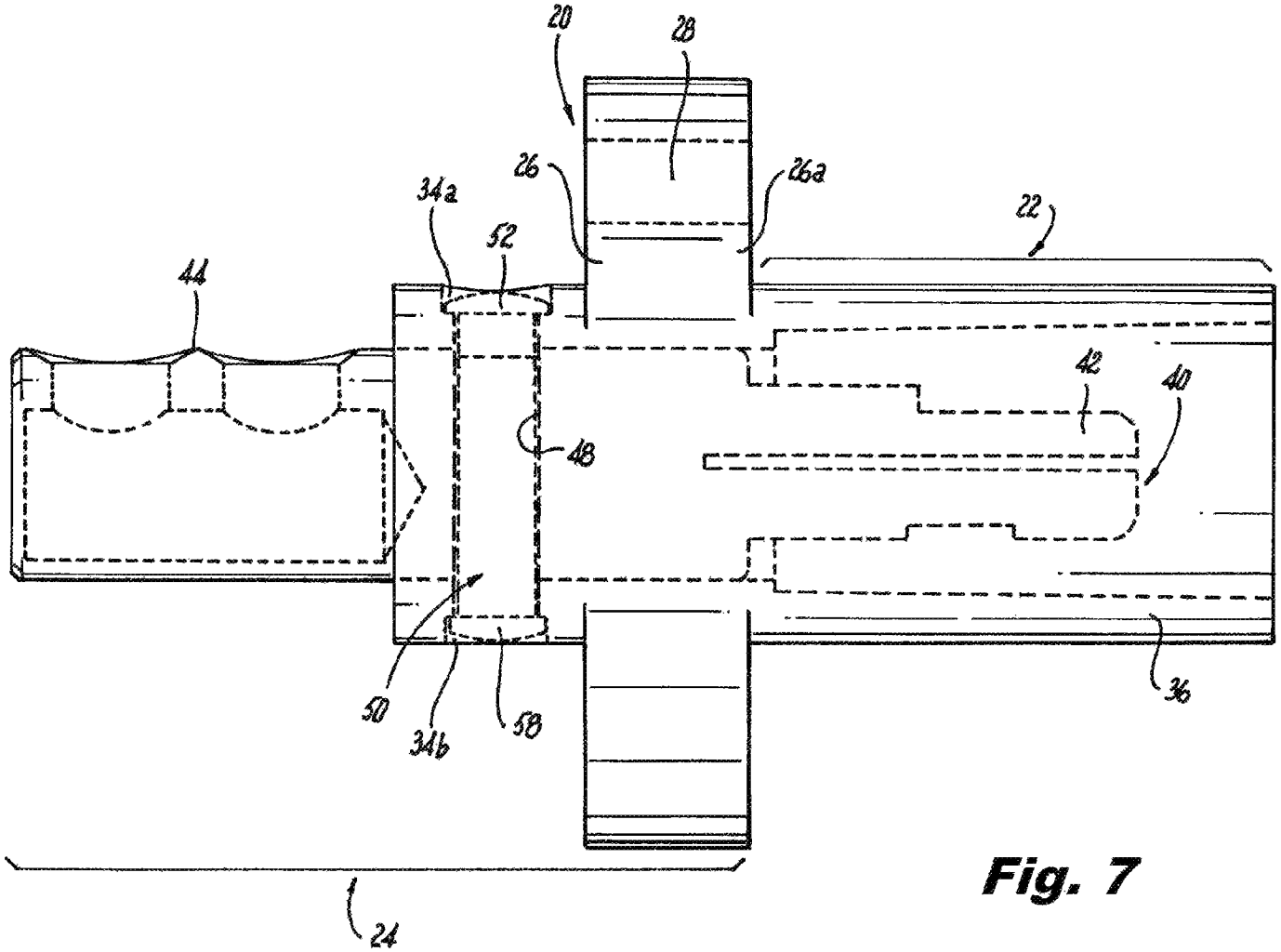
FIG. 7 is a side view of the male receptacle of FIG. 4, with the non-metallic pin inserted and heat staked.
Figure 8:
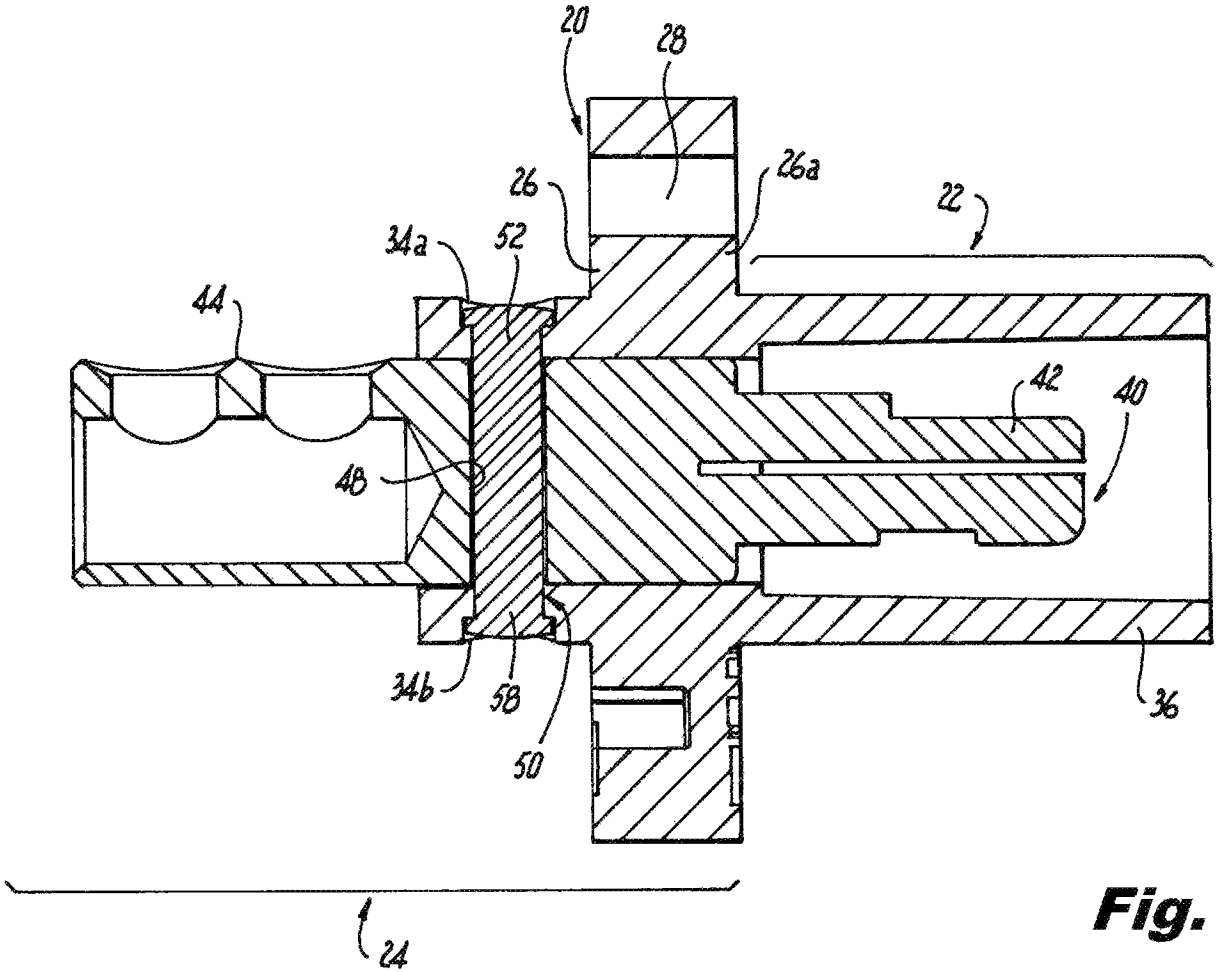
FIG. 8 is a cross-sectional view of the male receptacle of FIG. 6.

The receptacle side 22 of the panel mount housing 20 has a contact shroud 36 that surrounds a male or female contact of the electrical connector 40 extending through the panel mount housing 20, as shown in FIGS. 1 and 5. The contact shroud 36 is preferably circular and configure to mate with a comparable plug, such as the Male Plug or Female plugs manufactured by Hubbell, Inc. Examples of Male Plugs are the HBL15MRxx and HBL15MRSxx series of plugs manufactured by Hubbell, Inc., and examples of Female Plugs are the HBL15FRxx and HBL15FRSxx series of plugs manufactured by Hubbell, Inc. However, one skilled in the art would recognize that the shape of the contact shroud may be any shape that is compatible with various shaped plugs.

The termination side 24 of the panel mount housing 20 has a mounting section 26 that has a surface 26*a* configured to rest against a panel wall when installed, and provides a mounting structure for securing the receptacle 10 to a panel wall. The mounting section 26 has a plurality of mounting holes 28 where a bolt may be inserted through the panel mount housing 20 and through matching holes in a panel wall so that the panel mount receptacle 10 can be securely fastened to a panel wall. An extension ring 30 extends from the mounting section 26 on the termination side 24 of the panel mount housing 20. The extension ring 30 has an elongated key 32 that preferably extends the length of the extension ring, and a pair of holes 34*a* and 34*b* to receive a non-metallic retaining pin 50 (shown in FIG. 5). The holes may be different in size to ensure the retaining pin is inserted into the panel mount housing 20 in a consistent way for subsequent heat staking described below.

The panel mount housing 20 is preferably made of a non-conductive material, such as thermoplastic, a thermoplastic elastomer, or a synthetic thermoset rubber, and may be color coded to meet NEC electrical specifications. It should be noted that while described as different parts, the panel mount housing is preferable a single housing.

As described above, the electrical connector 40 extends through the panel mount housing 20. The electrical connector 40 has a contact 42 and a termination 44, seen in FIG. 5. The contact 42 extends from the extension ring 30 through the mounting section 26 and into the contact shroud 36. As seen in FIG. 1, at least the portion of the contact 42 within the extension ring 30 has a keyway 46 that fits within key 32 in the extension ring 30. The key and keyway configuration align the electrical connector 40 within the panel mount housing 20, and ease stress on the retaining pin when a plug is mated with the contact 42 and rotated to secure the plug to the male contact. The contact 42 also includes a hole 48 positioned to align with the holes 34 in the extension ring 30. The contact may be a male contact or a female contact, and is made of an electrically conductive material suitable to conduct low and high currents. Examples of suitable materials for the contact include brass and tin plated copper. Examples of suitable electrical connectors include the HBLxxxRCM series and HBLxxxRCF series contacts manufactured by Hubbell, Inc.

Figure 2:
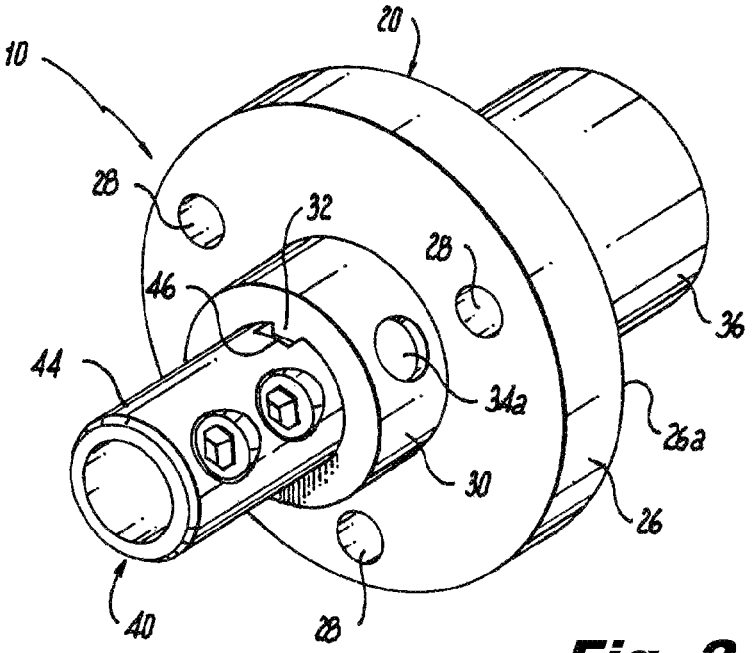
FIG. 2 is a perspective view of a panel mount receptacle double set screw type according to another embodiment of the present disclosure.

Continuing to refer to FIGS. 1 and 5, the termination 44 extends outwardly from the contact 42 starting at a point adjacent the extension ring 30, as seen in FIGS. 1 and 2. The termination 44 may be any conventional termination used to securely connect an electrical cable to the electrical connector 40. Examples of such terminations include a threaded lug termination, seen in FIG. 1, a set screw termination, seen in FIG. 2, or a buss bar termination. The termination is made of an electrically conductive material suitable to conduct low and high currents. Examples of suitable materials for the termination include brass and tin plated copper. Typically, the termination 44 and contact 42 are a single structure forming the electrical connector 40.

Figure 3:
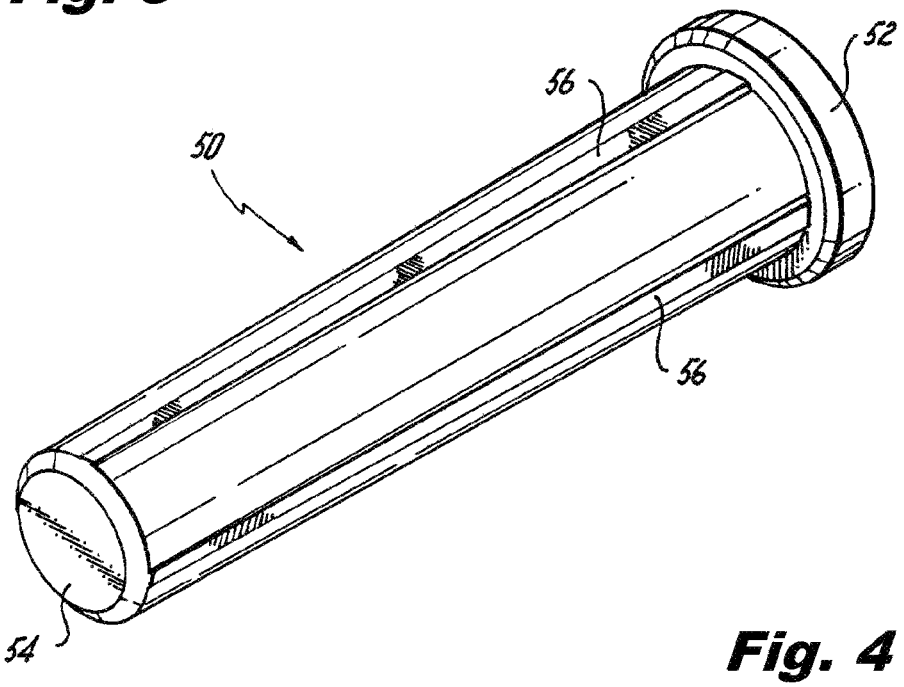
FIG. 3 is a perspective view of an embodiment of a non metallic retaining pin used to secure an electrical connector to a panel mount receptacle housing.

To secure the electrical connector 40 to the panel mount housing 20, a retaining pin 50, seen in FIG. 3, is used. In one embodiment, the retaining pin 50 has an endcap 52 and is tapered such that the widest diameter of the pin 50 is at the endcap 52 and the diameter tapers to the narrowest diameter as the distal end 54. In another embodiment, the retaining pin 50 has a uniform diameter, an endcap 52, and includes a plurality of tapered crushing ribs 56 spaced apart along the perimeter of the retaining pin. The tapered crushing ribs 56 extend along the length of the retaining pin 50 from the endcap 52 to the distal end 54, as seen in FIG. 3. Preferably, the retaining pin 50 is made of non-conductive and/or non-metallic material that is capable of being heat staked. An example of a suitable non-metallic material is a thermoplastic material.

Figure 4:
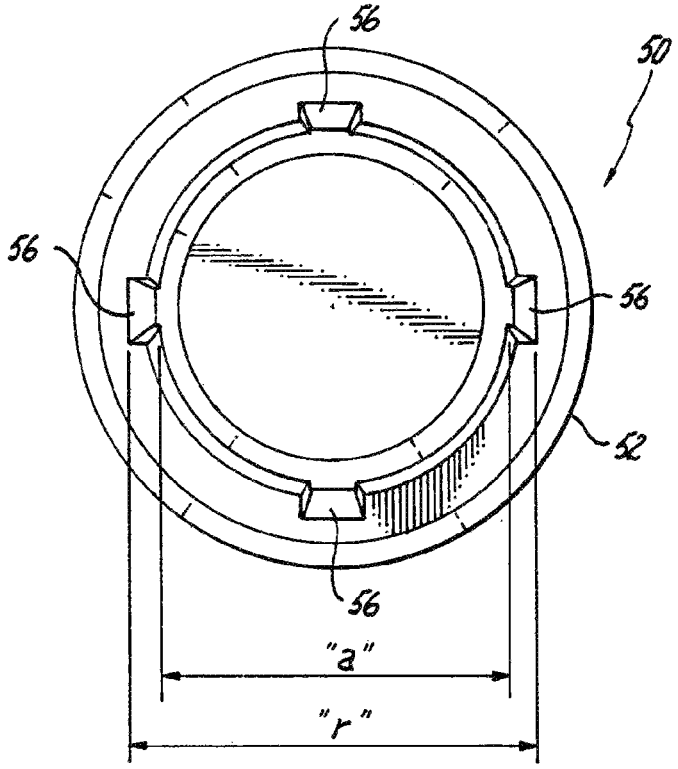
FIG. 4 is an elevational view of the non-metallic retaining pin of FIG. 3, looking from a far end toward an endcap of the pin.

To ensure consistent positioning of the retaining pin 50 within panel mount housing 20 for heat staking, hole 34*a* can have a diameter that is larger than hole 34*b*. The larger diameter hole 34*a* may have a diameter large enough to receive the entire length of the retaining pin 50 up to the endcap 52. That is, and referring to FIG. 4, the hole 34*a* has a diameter "r" which is about the size of the core diameter of the retaining pin plus the added diameter created by the crushing ribs. Hole 34*b* would have a diameter "a" that is about the size of the of the core diameter of the retaining pin 50.

Referring to FIGS. 5-8, to secure the electrical connector 40 to the panel mount housing 20 according to one embodiment, the retaining pin 50 is inserted into hole 34*a* in extension ring 30, through hole 48 in the contact 42 and out through the hole 34*b* in extension ring 30. As the retaining pin 50 is inserted into the extension ring 30 and contact 40, the crushing ribs 56 engage the walls of the holes 34 and 48, and are compress to form a tight fit of the retaining pin 50 within the holes, thus tightly securing the contact 40 to the panel mount housing 20. To provide a secure endcap on the retaining pin 50, the retaining pin is then heat staked so that the distal end 54 of the retaining pin 50 has an endcap 58, which is similar to endcap 52. Heat staking is a known process of deforming a non-metallic member, e.g., a plastic stud, pin or boss, to capture another part. Heat staking is performed with a contoured tool that transfers heat to the non-metallic member producing a melt phase and then exerting pressure to reform the non-metallic member. Heat stake profiles can have numerous different forms, including, a standard profile, a knurled profile, a dome profile, a flush profile, or a hollow profile.

The receptacles according to the present disclosure provide safe electrical power in numerous applications, such as to supply power to manufacturing machinery, generators, lighting systems and sound stages, amusement park attractions and rides, sporting stadiums. However, it will be understood that various modifications can be made to the embodiments of the present disclosure herein without departing from the spirit and scope thereof. Therefore, the above description should not be construed as limiting the disclosure, but merely as embodiments thereof. Those skilled in the art will envision other modifications within the scope and spirit of the invention as defined by the claims appended hereto.

What is claimed is:

1. A panel mount receptacle, comprising:

an electrical connector having a contact and a termination;

a panel mount housing having a mounting section that provides a mounting structure for securing the panel mount receptacle to a panel wall, an extension ring extending from one side of the mounting section, and a contact shroud extending from another side of the mounting section;

wherein the extension ring has an elongated key extending the length of the extension ring, and a pair of holes;

wherein the electrical connector has an elongated keyway configured to mate with the elongated key of the extension ring, and a hole that can be aligned with the pair of holes in the extension ring;

wherein the electrical connector is positioned within the panel mount housing such that the termination extends outwardly from the extension ring, the elongated keyway is mated with the elongated key, and at least a portion of the contact is positioned within the contact shroud;

wherein the electrical connector is secured to the panel mount housing with a non-conductive retaining pin positioned in the pair of holes in the extension ring and the hole in the electrical connector; and wherein the non-conductive retaining pin has an endcap and a body structure that is tapered such that a widest diameter of the body structure is adjacent the endcap and the body structure gradually tapers along its length to a narrowest diameter at a distal end of the body structure.

2. The panel mount receptacle according to claim 1, wherein the electrical connector is formed of brass.

3. The panel mount receptacle according to claim 1, wherein the panel mount housing is formed of thermoplastic.

4. The panel mount receptacle according to claim 1, wherein the non-conductive retaining pin is formed of a non-metallic material.

5. The panel mount receptacle according to claim 4, wherein the non-metallic material comprises thermoplastic.

6. The panel mount receptacle according to claim 1, wherein the body structure comprises a plurality of tapered crushing ribs, each crushing rib extending from the endcap to the distal end.

7. The panel mount receptacle according to claim 6, wherein the non-conductive retaining pin is formed of a non-metallic material.

8. The panel mount receptacle according to claim 1, wherein the non-conductive retaining pin has a second endcap adjacent the distal end of the body structure.

9. The panel mount receptacle according to claim 8, wherein the non-conductive retaining pin is formed of a non-metallic material.

10. A panel mount receptacle, comprising:

an electrical connector having a contact and a termination; and a panel mount housing having a mounting section that provides a mounting structure for securing the panel mount receptacle to a panel wall, an extension ring extending from one side of the mounting section and having a pair of holes, and a contact shroud extending from another side of the mounting section;

wherein the electrical connector is positioned within the panel mount housing such that the termination extends outwardly from the extension ring, and at least a portion of the contact is positioned within the contact shroud;

wherein the electrical connector has a hole that can be aligned with the pair of holes in the extension ring, and is secured to the panel mount housing with a non-conductive retaining pin positioned in the pair of holes in the extension ring and the hole in the electrical connector;

wherein the non-conductive retaining pin has an endcap and a body structure that is tapered such that a widest diameter of the body structure is adjacent the endcap and the body structure gradually tapers along its length to a narrowest diameter at a distal end of the body structure; and wherein the extension ring has an elongated key and the electrical connector has an elongated keyway configured to mate with the elongated key, and wherein the electrical connector is positioned within the panel mount housing such that the termination extends outwardly from the extension ring, the elongated keyway is mated with the elongated key, and the at least a portion of the contact is positioned within the contact shroud.

11. The panel mount receptacle according to claim 10, wherein the electrical connector is formed of brass.

12. The panel mount receptacle according to claim 10, wherein the panel mount housing is formed of thermoplastic.

13. The panel mount receptacle according to claim 10, wherein the non-conductive retaining pin is formed of a non-metallic material.

14. The panel mount receptacle according to claim 13, wherein the non-metallic material comprises thermoplastic.

15. The panel mount receptacle according to claim 10, wherein the body structure comprises a plurality of tapered crushing ribs, each crushing rib extending from the endcap to the distal end.

16. The panel mount receptacle according to claim 10, wherein the non-conductive retaining pin has a second endcap adjacent the distal end of the body structure.

17. The panel mount receptacle according to claim 16, wherein the second endcap is formed after the non-conductive retaining pin is positioned in the pair of holes in the extension ring.

18. A panel mount receptacle, comprising:

a panel mount housing having a mounting section that provides a mounting structure for securing the panel mount receptacle to a panel wall, and a contact shroud extending from one side of the mounting section, wherein the mounting section has an extension ring;

an electrical connector having a contact and a termination positioned within the panel mount housing such that the termination extends outwardly from a side of the mounting section opposite the contact shroud and at least a portion of the contact is positioned within the contact shroud;

a non-conductive retaining pin securing the electrical connector to the panel mount housing, the non-conductive retaining pin being positioned within a pair of holes in the panel mount housing and within a hole in the electrical connector; and wherein the non-conductive retaining pin has an endcap and a body structure that is tapered such that a widest diameter of the body structure is adjacent the endcap and the body structure gradually tapers along its length to a narrowest diameter at a distal end of the tapered body structure; and wherein the extension ring has an elongated key and the electrical connector has an elongated keyway configured to mate with the elongated key, and wherein the electrical connector is positioned within the panel mount housing such that the termination extends outwardly from the extension ring, the elongated keyway is mated with the elongated key, and the at least a portion of the contact is positioned within the contact shroud.

19. The panel mount receptacle according to claim 18, wherein the extension ring extends from another side of the mounting section, wherein the extension ring has the pair of holes.

20. The panel mount receptacle according to claim 19, wherein the non-conductive retaining pin is positioned within the pair of holes in the extension ring and within the hole in the electrical connector.

21. The panel mount receptacle according to claim 18, wherein the panel mount housing is formed of thermoplastic.

22. The panel mount receptacle according to claim 18, wherein electrical connector is formed of brass.

23. The panel mount receptacle according to claim 18, wherein the non-conductive retaining pin is formed of a non-metallic material.

24. The panel mount receptacle according to claim 23, wherein the non-metallic material comprises thermoplastic.

25. The panel mount receptacle according to claim 18, wherein the body structure comprises a plurality of tapered crushing ribs, each crushing rib extending from the endcap to the distal end.

26. The panel mount receptacle according to claim 25, wherein the panel mount housing has an elongated key and the electrical connector has an elongated keyway configured to mate with the elongated key, and wherein the electrical connector is positioned within the panel mount housing such that the termination extends outwardly from the panel mount housing, the elongated keyway is mated with the elongated key, and the at least a portion of the contact is positioned within the contact shroud.

27. The panel mount receptacle according to claim 18, wherein the non-conductive retaining pin has a second endcap adjacent the distal end of the body structure.

28. The panel mount receptacle according to claim 27, wherein the second endcap is formed after the non-conductive retaining pin is positioned in the pair of holes in the panel mount housing.

* * * * *